US006973702B2

(12) United States Patent
Harashige

(10) Patent No.: US 6,973,702 B2
(45) Date of Patent: Dec. 13, 2005

(54) WEB EXPANDER

(75) Inventor: Masahiro Harashige, Tomisato (JP)

(73) Assignee: Nippon Petrochemical Co., Ltd., Tokyo (JP)

( * ) Notice: Subject to any disclaimer, the term of this patent is extended or adjusted under 35 U.S.C. 154(b) by 196 days.

(21) Appl. No.: 10/601,846

(22) Filed: Jun. 24, 2003

(65) Prior Publication Data

US 2004/0000041 A1 Jan. 1, 2004

(30) Foreign Application Priority Data

Jun. 26, 2002 (JP) ..... 2002-186456

(51) Int. Cl.[7] ..... D06C 3/00
(52) U.S. Cl. ..... 26/51; 26/71; 26/99
(58) Field of Search ..... 26/51, 87, 88, 26/90, 97, 99–105, 51.3, 51.4, 51.5, 71, 74, 26/75, 18.5, 18.6; 28/165; 264/280, 288.4, 264/288.8, 289.6, 290.2, 291, DIG. 73

(56) References Cited

U.S. PATENT DOCUMENTS 829,805 A * 8/1906 Sackville ..... 26/101
1,347,714 A * 7/1920 Rowley ..... 26/25
3,042,989 A * 7/1962 Foley ..... 26/100
3,509,607 A * 5/1970 Fleissner ..... 26/97
3,828,998 A * 8/1974 Gross ..... 26/105
4,007,865 A * 2/1977 Crandall ..... 226/17
4,291,441 A * 9/1981 Bassani ..... 26/75
4,629,525 A * 12/1986 Rasmussen ..... 156/84
5,259,097 A * 11/1993 Aihara et al. ..... 26/92
5,455,992 A * 10/1995 Kurschatke et al. ..... 26/99
5,729,878 A * 3/1998 Kurihara et al. ..... 26/101
5,791,030 A 8/1998 Aihara et al. ..... 26/87
5,826,314 A * 10/1998 Aihara et al. ..... 26/88

* cited by examiner

*Primary Examiner*—A. Vanatta
(74) *Attorney, Agent, or Firm*—Bucknam and Archer

(57) ABSTRACT

This invention provides a web expander comprising means for carrying a web 2 having longitudinal slits, means 5 for expanding the width of the web, and opening control means 6 for uniformly forming size and form of openings of the web expanded by said means for expanding. The means 5 for expanding the width consists of a flat expander 15 and two pairs of cloth guider 21, and opening control means 6 comprises two expander rolls 31 as a rotatable ribbed roll, the ribbed roll being adapted to be applied to one side of the traveling net-like web to rotate in the direction in which the net-like web 2 is reduced in width.

14 Claims, 6 Drawing Sheets

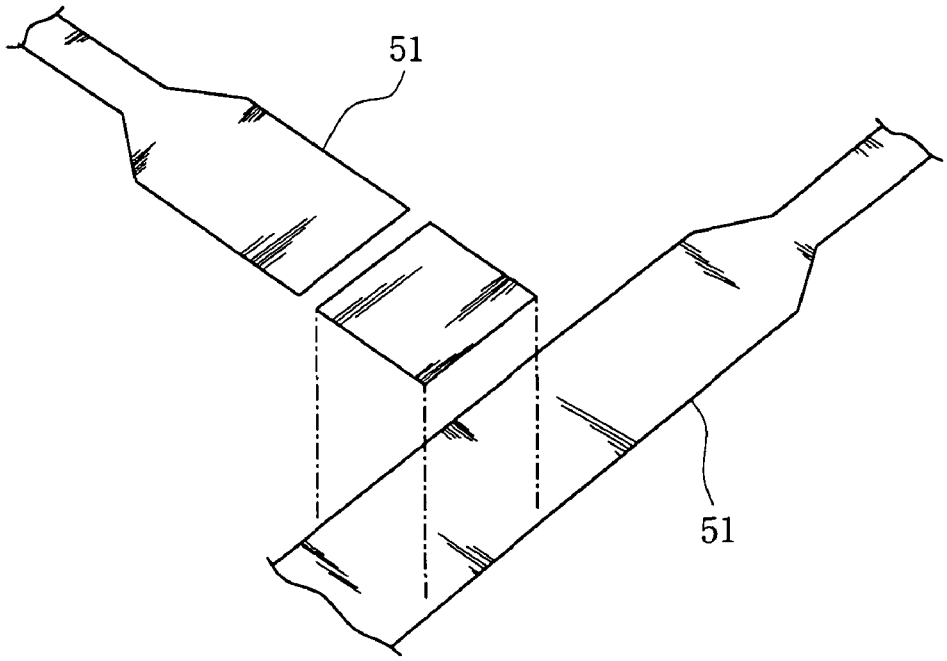
Fig. 9 (a) (Prior Art)
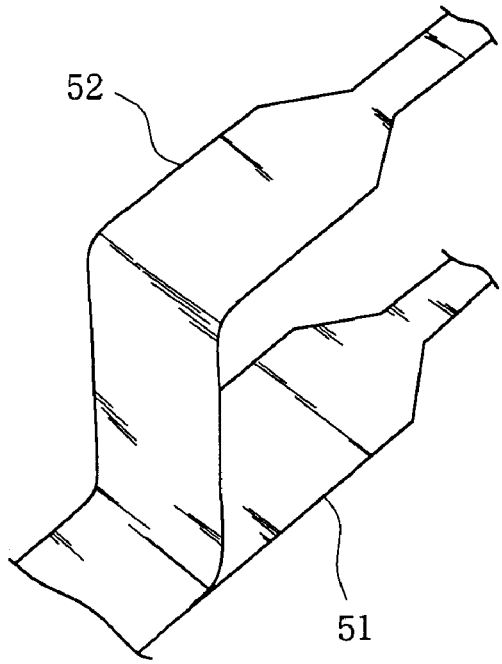
Fig. 9 (b) (Prior Art)

WEB EXPANDER

BACKGROUND OF THE INVENTION

1. Field of the Invention

The present invention relates to an apparatus for laterally expanding a traveling web having longitudinal slits, which can be used in making non-woven fabric.

2. Background Art

A conventional method for producing non-woven fabric laminations comprises the steps of: preparing longitudinally elongated, split films 51 each having a lot of long or short slits longitudinally made therein; laterally expanding the split webs 51; and laying them crosswise on each other as shown in FIG. 9(*a*) to provide a non-woven fabric lamination. Otherwise, as shown in FIG. 9(*b*), longitudinally split-and-laterally expanded films 51 and laterally split-and-laterally expanded films 52 are alternately laid on each other to provide a non-woven fabric lamination. Non-woven fabric laminations thus provided are strong, light, stable in size, and air-permeable, and can be used as reinforcement materials.

A conventional net-like web expander comprises a curved application rod, a rubber roll, a screw roll having spiral grooves made on its circumference or a cloth guider which grip the opposite longitudinal edges of the net-like web to pull it wide.

Another conventional expander is called "Cage Roll", which is shown for example, in Japan Patent Application, Publication No. S-46-43,275. It comprises a pair of disks facing each other, somewhat inclined toward each other, and a plurality of coiled springs parallel-arranged at regular intervals on the circumferences of the opposite disks, and fixed thereto. The "cage roll" thus made is so placed relative to a net-like web to be expanded from side to side that the opposite disks are inclined toward each other symmetrically with respect to the center line of the net-like web, which is being fed from the upstream side of the expander. While the "cage roll" rotates, the coiled springs are sequentially put in contact with the traveling web in synchronism with the traveling speed of the web, thereby making the web to be forcedly expanded from side to side. Specifically the web is laid on the coiled springs of sequentially increasing length, and hence sequentially increasing spiral pitch (ring-to-ring distance), thereby sequentially stretching the series of wavy-contact portions of the web toward the required width.

The conventional expanders, however, cannot laterally expand web fibers evenly.

In view of this one object of the present invention is to provide a web expander which can laterally expand and distribute web fibers evenly across the required width.

SUMMARY OF THE INVENTION

To attain this object a web expander according to the present invention comprises a web expander comprising means for carrying a web having longitudinal slits, means for expanding the width of the web, and opening control means for uniformly forming size and form of openings of the web expanded by said means for expanding to form an expanded net-like web. Preferably the opening control means is a ribbed roll having raised lines formed on its circumference, which ribbed roll is rotated in the direction in which the raised lines function to decrease the width of the net-like web, which is kept in contact with the ribbed roll. The ribbed roll may be curved, and may be rotated while maintaining a direction of the curved condition. The ribbed roll may be straight, and may be rotated. Two or more ribbed rolls may be used. The means for expanding the width of a traveling web may include a cloth guider having two rolls so as to grasp one longitudinal edge portion of the net-like web. The means for expanding the width of a traveling web may include at least one member selected from the group consisting of a flat expander keeping in contact with one side of the net-like web for expansion, said flat expander having a plurality of parallel rubber strings laterally stretched, a cage roll having a plurality of coiled springs expandable laterally in the direction in which the net-like web is expanded, a bow rubber roll, a bow rod applicator and a screw roll having a screw groove made on its cylindrical surface. The means for expanding the width of a traveling web may include a controller for controlling the width of the net-like web.

According to the present invention, as may be understood from the above, the web expander is useful in expanding the traveling web having longitudinal slits with its openings opening wide in same size and form, providing the expanded net-like web having its fibers distributed even. Use of such expanded net-like web significantly improves the quality of non-woven fabric.

BRIEF DESCRPTION OF THE DRAWINGS

FIG. 9 is perspective view which illustrates how expanded webs are laminated.

DESCRIPTION OF THE PREFERERED EMBODIMENTS

Figure 1:
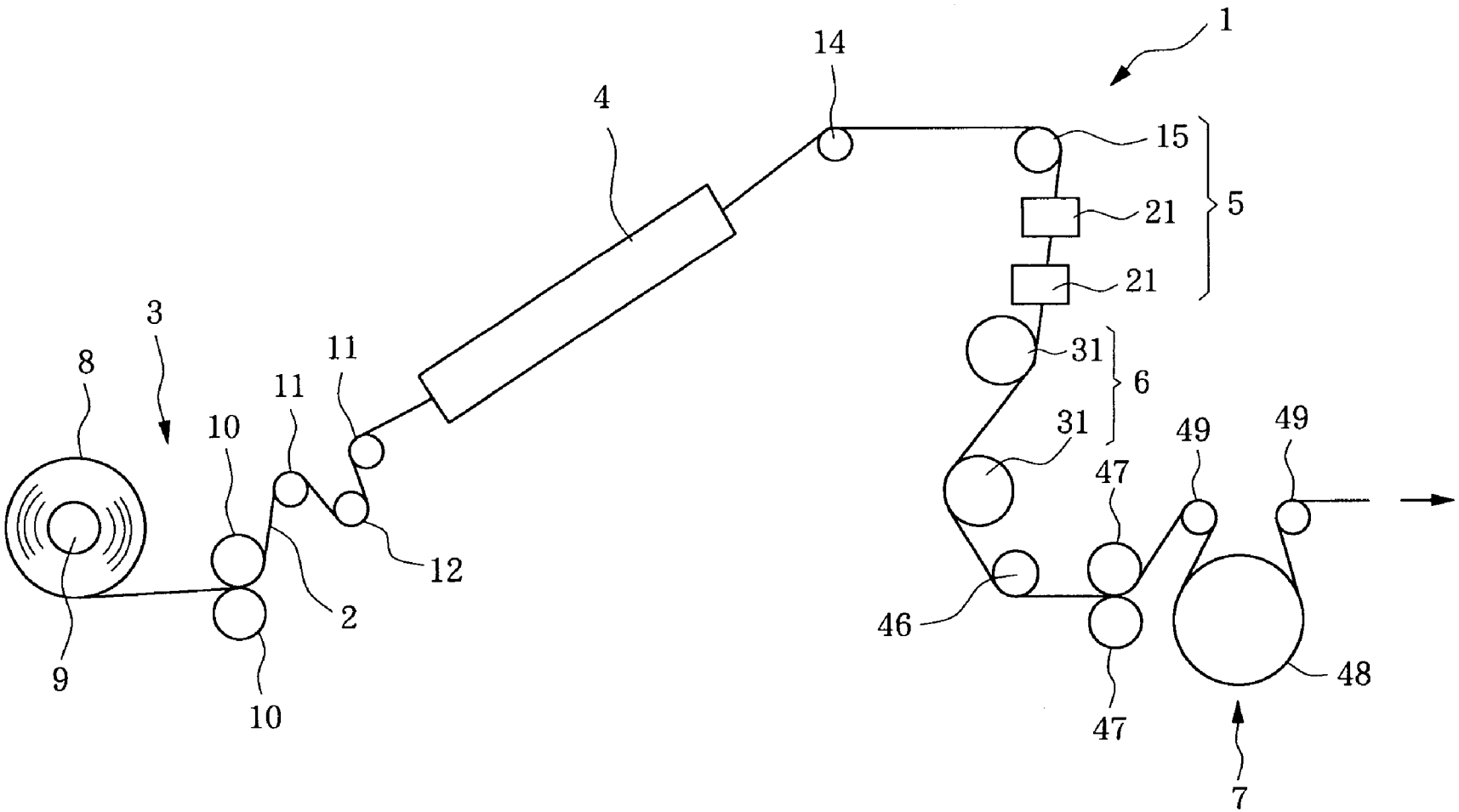
FIG. 1 illustrates a web expander according to one embodiment of the present invention.

A web expander according to one preferred embodiment of the present invention is described below by referring to accompanying drawings. FIG. 1 illustrates an outline of the web expander 1. It comprises a web feeding means 3 for feeding a pre-expansion web 2 from the upstream side of stream (traveling) of web to be expanded, an annealing oven 4, an expander unit 5 for expanding the traveling web 2 by means of carrying means such as web feeding means 3, an opening control means 6 for opening the slits of the expanded web into openings of same size and form, and a post-treatment means 7. All of these units and means are arranged in the order named in the upper-to-down stream direction.

The web feeding means 3 comprises a feeder 9 which is shown only an axis in FIG. 1 bearing a web roll 8, a pair of pinch rolls 10 to unroll and draw the web 2 from the web roll 8, two guide rolls 11 and a tension sensitive-and-adjustive roll 12 positioned between the two guide rolls 11. With this arrangement the web 2 pulled out by the pinch rolls 10, and the stretch applied to the traveling web 2 is controlled to be a fixed strength by the tension sensitive-and-adjustive roll 12 and by the guide rolls 11 while the web 2 is traveling from one to the other guide roll 11.

The annealing oven 4 comprises a duct equipped with a fan and a heater (not shown). The web 2 leaving the feeder is exposed to the blow of hot air to remove its distortion before reaching the expander unit 5. Thus, the web 2 is made free of strains and unevennesses completely, which would cause adverse effect on the web when expanded. The annealing oven 4, however, may be omitted, depending on the kind, characteristics and expansion rates of the web.

When the web 2 leaves the guide roll 14 on the downstream side of the annealing oven 4, it is subjected to expansion in the expander unit 5 where the web 2 is expanded somewhat wider than required. For the purpose the expander unit 5 comprises a flat expander 15 and two cloth guiders 21 placed on the downstream side of the flat expander 15.

Figure 2:
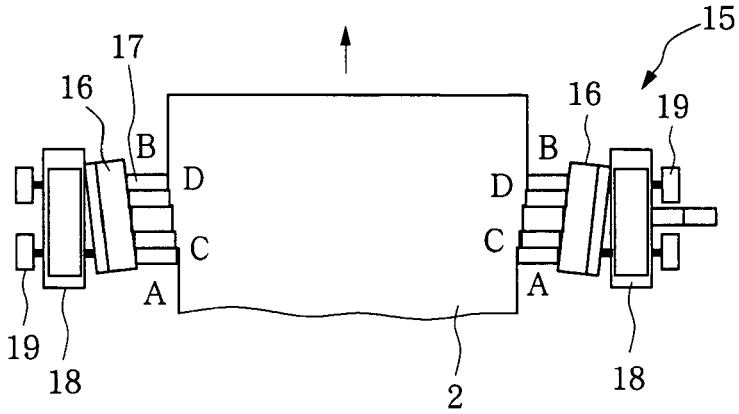
FIG. 2(*a*) is a plane view of a flat expander with a net-like web, and FIG. 2(*b*) is a cross-section of the flat expander.
Figure 2:
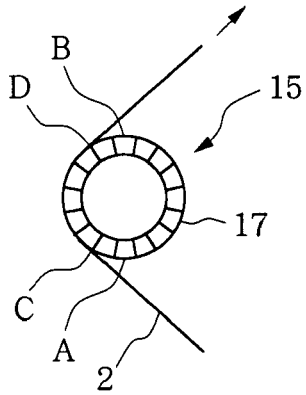

Referring to FIG. 2, the flat expander 15 comprises two rotatable disks 16 facing each other, and a plurality of parallel rubber strings 17 arranged at regular intervals on the circumferences of the opposite disks 16, and fastened thereto to form a cylindrical cage. Two opposite stationary stands 18 have adjustable screws 19 to abut on the opposite disks 16. The opposite disks 16 can be inclined by driving selected adjustable screws 19 so that they may be inclined symmetrically. When the opposite disks 16 thus symmetrically inclined toward each other rotate in synchronism with the traveling web 2, the rubber strings are sequentially put in contact with the traveling web in synchronism with the traveling speed of the web, thereby the web 2 can be forcedly expanded from side to side. For example, assuming that some adjustable screws 19 are tightened on the side of the web inlet, and that some other adjustable screws 19 are loosened on the side of the web outlet, the rubber strings 17 are allowed to shorten at Point "A" and to extend at Point B. The traveling web 2 is put in contact with the roll at Point C, and it is being continuously expanded before reaching Point D. The expansion is caused by the friction between the rubber strings 17 and the web 2.

Figure 3:
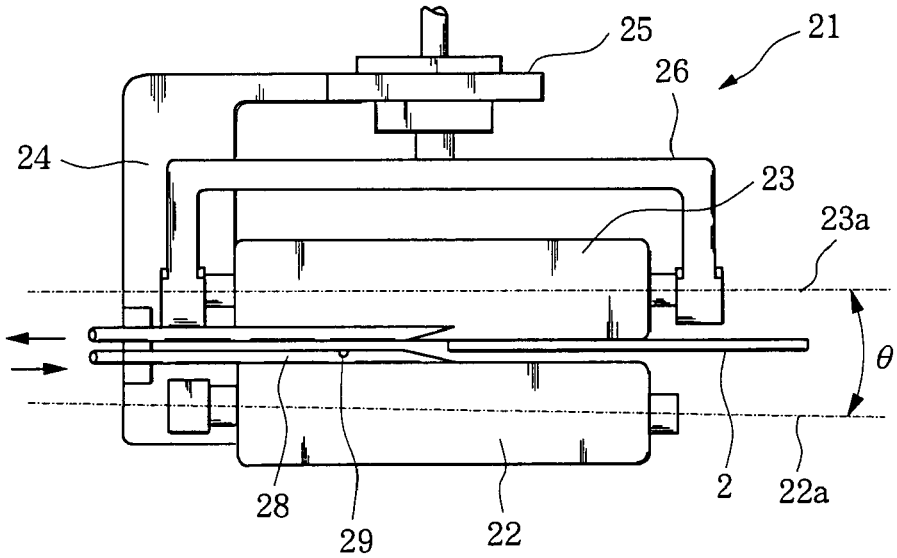
FIG. 3 is a front view of one example of cloth guider (expanding means) as viewed from the direction in which the net-like web travels.
Figure 4:
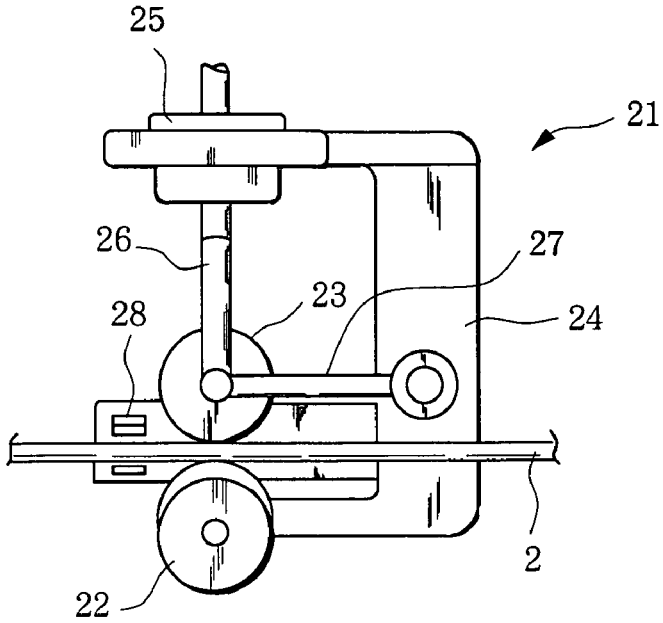
FIG. 4 is a side view of the cloth guider (expanding means) as viewed from the direction perpendicular to the web-traveling direction.

FIGS. 3 and 4 show a roll type of cloth guider as viewed in the web feeding direction and in the crosswise direction, which is perpendicular to the web feeding direction. The cloth guider 21 comprises two rolls 22 and 23 to grasp the traveling web 2 therebetween. These rolls 22 and 23 are rotatable. Their center lines 22*a* and 23*a* are laid in one and same plane, and the rolls 22 and 23 diverges somewhat toward the center line of the traveling web 2, forming a small divergent angle θ (see FIG. 3). In this particular embodiment two pairs of cloth guiders 22, 23 are arranged in series in the direction in which the web 2 travels, and two cloth guiders 22, 23 of each pair are arranged crosswise of the traveling web 2, and the rolls 22 and 23 are arranged one or the other longitudinal half of the web 2.

At least one of the two rolls 22 and 23 in each cloth guider 21 is made of an elastic material such as rubber. These rolls 22 and 23 pinch one longitudinal half of the web 2, diverging at a given angle θ so that their diverging ends may be separate to delimit the gap equal to two or more times as wide as the thickness of the web, and equal to 30 or less times as wide as the thickness of the web. Thus, the pulling force applied to the web to pull it laterally outward decreases toward the center of the web 2. If these rolls were closely applied to grasp either longitudinal half of the web 2, leaving no gap therebetween, the pinched longitudinal half of the web 2 could not be expanded, and the web 2 would be split longitudinally along the boundary between the opposite pinched halves of the web 2 because an increased splitting power is applied to the boundary. These two problems can be solved by inclining the rolls 22 and 23 of each cloth guider 21 in divergent form.

One roll 22 is at a fixed position to the roll support member 24. The other roll 23 is fixed to an opening-and-closing means, which comprises a pneumatic diaphragm 25 and an arm 26 which is movable to the direction of thickness of the web 2, so that the roll 23 can move close to and apart from the counter roll 22. Referring to FIG. 4, the cloth guider 21 has another arm 27 connecting the arm 26 to the roll support member 24, thereby preventing the arm 26 from turning about the pneumatic diaphragm 25. With this arrangement the roll 23 is limited to the movement in a plane in which the center axes 22*a* and 23*a* of the rolls 22 and 23 are contained. The opening-and-closing means can put the roll 23 in contact with the traveling web 2 without allowing the arm 26 from turning about the pneumatic diaphragm 25.

The cloth guider 21 is equipped with a pneumatic sensor 28 for detecting one longitudinal edge of the web 2. The pneumatic sensor 28 comprises upper and lower pneumatic pipes leaving therebetween a small gap still permitting invasion of the net-like web 2 (see FIG. 3). The lower pipe has a small hole 29 for ejecting an air stream toward the upper pipe, which draws the air stream. When the cloth guider 21 pulls the longitudinal edge of the net-like web 2 to the air port 29, the air stream is interrupted, and interruption of the air stream is detected to send a signal to a control (not shown). The control is responsive to the signal representing interruption of the air stream for controlling the opening-and-closing of the cloth guider 21. Specifically, when the longitudinal edge of the net-like web 2 reaches the air port 29, an associated pneumatic valve (not shown) is actuated to put the pneumatic diaphragm 25 in operation, thereby momentarily releasing the net-like web 2 from the cloth guider 21 to allow the longitudinal edge of the net-like web 2 to leave apart from the air port 29 in the direction in which the web 2 decreases in width. And immediately the longitudinal edge of the web 2 is caught again by the upper and lower rolls 22 and 23 to be pinched therebetween. This is repeated to expand the net-like web 2 to a fixed width as required. A contact type or photo-electric type of sensor may be used in place of the pneumatic sensor.

Figure 5:
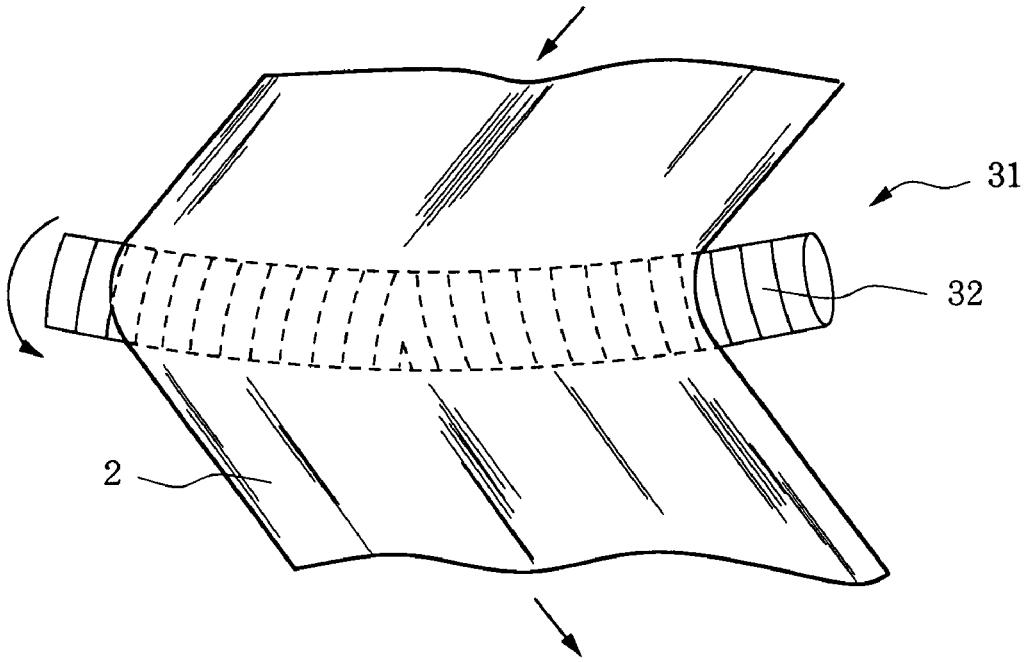
FIG. 5 is a perspective view of a ribbed roll (opening control means) with a net-like web.
Figure 6:
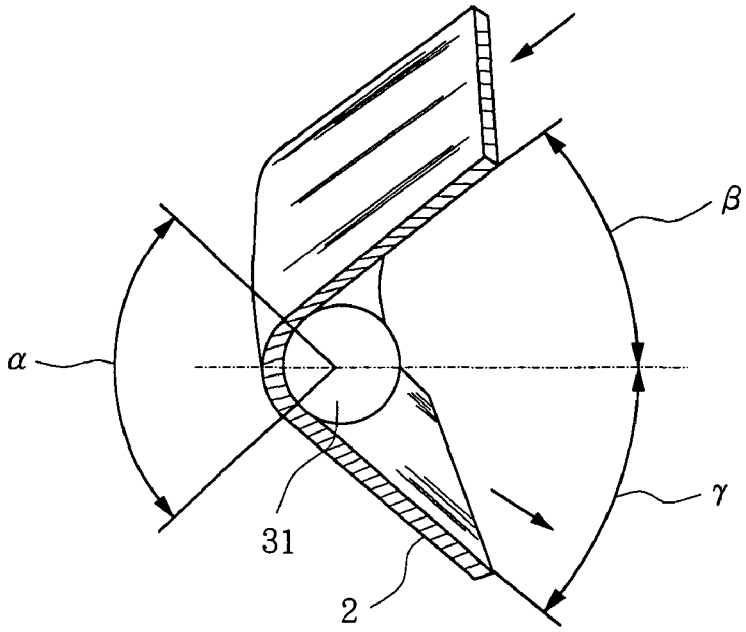
FIG. 6 illustrates the ribbed roll with a net-like web.
Figure 7:
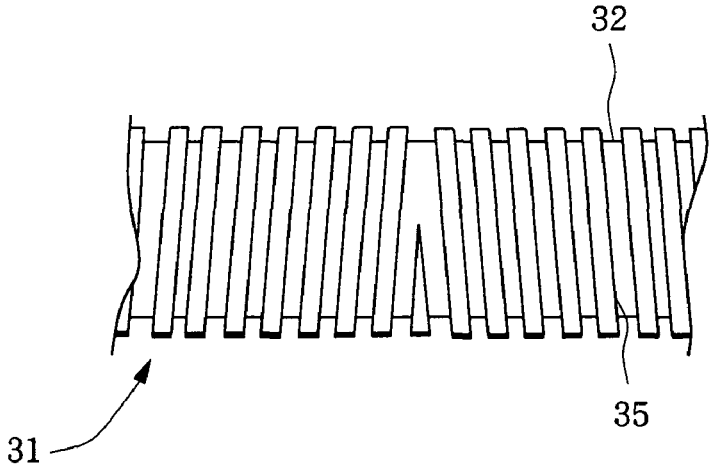
FIG. 7 is an enlarged view of a fragment of the ribbed roll.

The opening control means 6 comprises one ribbed-roll 31 put in contact with one side of the net-like web 2 and another ribbed-roll 31 put in contact with the other side (see FIG. 1). FIG. 5 illustrates the ribbed roll 31 and FIG. 6 illustrates how the ribbed roll 31 is applied to one side of the netlike web 2 (fibers not shown). As shown in FIG. 5, the ribbed roll 31 has a plurality of oblique grooves 32 made on its circumference, and it is curved and applied to the net-like web 2. The oblique grooves 32 are inclined symmetric relative to the center of the roll 31, thus forming spiral rib-like ridges 35 (see FIG. 7), which are inclined to be symmetric with respect to the center of the net-like web 2. The curved ridged-roll 31 is forcedly rotated while maintaining a direction of the curved condition by an exterior drive (not shown) in the direction in which the net-like web 2 (one side of which is put in contact with the ribbed-roll 31) is fed. The ribbed roll 31 is arranged so that the opposite spiral ribs 35 may be directed to reduce the width of the net-like web 2.

Preferably the net-like web 2 comes close to the curved roll 31 on its concave side, and leaves the curved roll 31 on its convex side while maintaining a direction of the curved condition. The openings equalizing effect caused by the ribbed roll 31 depends on the bending curvature of the ribbed roll, the contact angle α, the traveling-in angle β formed between the plane including a curved axis and the incoming net-like web 2, the traveling-out angle γ formed between the plane including a curved axis and the outgoing net-like web 2, the tension of the net-like web 2, the rib-to-rib distance, the rotating speed of the ribbed roll relative to the traveling web and other factors. Also, it should be noted that the ribbed roll need not be forcedly rotated, and that it is allowed to freely rotate when the net-like web 2 is traveling.

The post-treatment means 7 comprises a guide roll 46, a pair of pinch rolls 47, an annealing roll 48 and two guide rolls 49 arranged on the annealing roll 48, as seen from FIG. 1. The annealing roll 48 is placed between the guide rolls 49 on the downstream side of the pinch rolls 47. Thus, the travelling path the net-like web 2 follows is completed.

Figure 8:
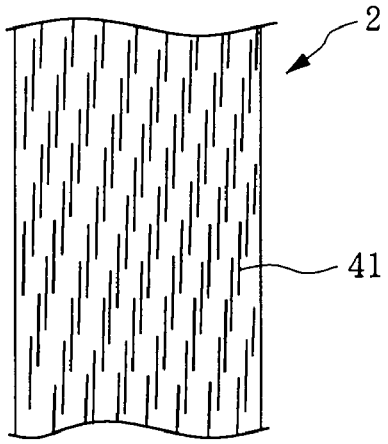
FIG. 8(*a*) is a plane view of a silted web prior to expansion, and FIG. 8(*b*) is a plane view of a silted web posterior to expansion.
Figure 8:
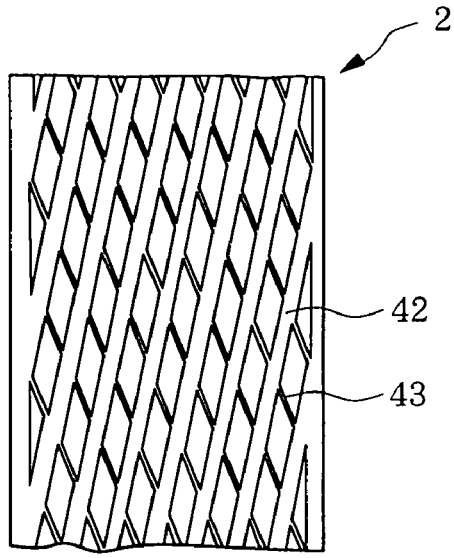

FIG. 8(*a*) shows a fragmentary piece of split web 2 prior to expansion, whereas FIG. 8(*b*) shows the fragmentary piece of net-like web 2 posterior to expansion. As shown, the prior-expansion web (split web) has a lot of short slits 41 longitudinally arranged, and the posterior-expansion web (net-like web) has oblique fibers 42 and counter-oblique fibers 43 arranged therein.

Referring to FIG. 1 again, the expander 1 is used in expanding a triple-layered, split web 2 containing a high density polyethylene in its center layer, and low density polyethylene in both surface layers thereof. The web 2 is pulled out from the roll 3, starting laterally expanding the netlike web 2 at the tension sensitive-and-adjustive roll 12, and traveling to the flat expander 15 while increasing its width at a fixed expanding angle. The flat expander 15 rotates while keeping in contact with the traveling net-like web 2. The flat expander 15 shuttles in its axial direction with the stroke of approximately 30 mm or below, thus limiting the expansion of the net-like web to relatively small amount.

However, since the net-like web 2 is pulled by the leading length to begin expanding at the guide roll 11 on the downstream side of the tension sensitive-and-adjustive roll 12 prior to arrival at the flat expander 15, the action of expanding by the flat expander 15 is increasingly accumulated. The more the net-like web 2 expands, the more the oblique fibers 42 and counter oblique fibers 43 incline (FIG. 8). The opening control means 6 effectively works the while, opening the openings into same size and form. Thus, the expansion ratio gradually converges toward a fixed value at which the width-expansion and the opening shaping-and-sizing are put in an equilibrium. A significantly large expansion ratio can be obtained by placing the flat expander 15 apart from the tension sensitive-and-adjustive roll 12 by a good distance. In this particular embodiment the expansion rate can be increased three to four times without difficulty. The net-like web 2 is apt to be expanded much wider in its center area. To assure that the net-like web is expanded evenly from side to side, the expansion rate is set for approximately two times at the flat expander 15. Specifically the net-like web 2 at the flat expander 15 is about two times as wide as the split web 2 at the tension sensitive-and-adjustive roll 12, and the net-like web 2 is expanded still more at the cloth guider 21, where the net-like web 2 is expanded somewhat wider than required. The divergent angle is determined, largely depending on the kind or nature of the net-like web 2. If the divergent angle is too large, the openings in the intermediate area of the net-like web 2 are opened so wide that the net-like web 2 may be torn easily.

The width of the net-like web 2 prior to the upstream cloth guider 21 varies depending on the kind of the web material, the tension of the web, and other factors. Also, the width of the net-like web 2 is influenced by the on-and-off operation of the cloth guider 21. As a result, the net-like web 2 prior to the downstream cloth guider 21 is too large or small in width. Sometimes the net-like web 2 leaves the cloth guider 21 sideways, or the width of the net-like web grows irregular. To solve this problem a width-sensitive detector or sensor is put between the flat expander 15 and the cloth guider 21. Alternatively, means for detecting the opening-and-closing frequency of the cloth guider 21 may be used. The signal from such sensor or detector is directed to a controller (not shown), which is responsive to the signal from the sensor or detector for feed-back automatically controlling the expansion of the net-like web 2 by the flat expander 15, thereby keeping the width of the net-like web 2 within limits at the detecting position.

After the net-like web is expanded to the required width in the opening control means 6, the strain of the net-like web caused by opening the openings into same size and form, is removed in the annealing roll 48, at the same time, the openings are uniformed by heat shrink action of the fibers, and fibers are distributed evenly. Then, the net-like web thus expanded is sent to the subsequent step.

The flat expander commercially available in the name of "Webster" or "Slat Expander" can be used as the expander 5. A cage-like roll, cloth guider, curved rubber roll, curved rod applicator, or screw roll may be equally used. Three or more pairs of cloth guiders may be used.

Two ribbed-rolls 31 are used, but one ribbed-roll or three or more ribbed-rolls may be used to meet the occasional request. Straight ribbed-rolls are still effective in opening the openings into same size and form. The guide ribs 35 need not be arranged continuously. It suffices that their arrangement is effective in guiding and reducing the net-like web in width no matter how they may be arranged. The width-sensitive sensor may be of the contact, photo-electric, image sensor, or pneumatic type or any other type. The most appropriate one for the particular kind of net-like web to be expanded may be selectively used. Screw rolls, bow rolls, and circular-arc rods (R bar) may be selectively used in combination.

What is claimed is:

1. A web expander comprising means for carrying a traveling web having longitudinal slits, means for expanding the width of the traveling web to expand the slits thereby forming openings, and opening control means for uniformly forming the size and shape of said openings of the web expanded by said means for expanding, said opening control means comprising a rotatable ribbed roll having a plurality of ribs formed on its circumference, the ribbed roll being adapted to be applied to one side of the traveling web to rotate in the direction in which the web is reduced in width.

2. A web expander according to claim 1, wherein said ribbed roll has a plurality of oblique grooves made on its circumference.

3. A web expander according to claim 2, wherein said oblique grooves are spiral riblike ridges.

4. A web expander according to claim 2, wherein said oblique grooves are inclined to be symmetric with respect to the center of the web.

5. A web expander according to claim 1, wherein said ribbed roll is curved, and is rotated while maintaining a direction of the curved condition.

6. A web expander according to claim 1, wherein said ribbed roll is straight, and is rotated.

7. A web expander according to claim 1, wherein two or more ribbed rolls are used.

8. A web expander according to claim 5, wherein two or more ribbed rolls are used.

9. A web expander according to claim 6, wherein two or more ribbed rolls are used.

10. A web expander according to claim 1, wherein said means for expanding the width of a traveling web includes a cloth guider having two rolls so as to grasp one longitudinal edge portion of the web.

11. A web expander according to claim 1, wherein said means for expanding the width of a traveling web includes at least one member selected from the group consisting of a flat expander keeping in contact with one side of the web for expansion, said flat expander having a plurality of parallel rubber strings laterally stretched, a cage roll having a plurality of coiled springs expandable laterally in the direction in which the web is expanded, a bow rubber roll, a bow rod applicator and a screw roll having a screw groove made on its cylindrical surface.

12. A web expander according to claim 1, wherein said means for expanding the width of a traveling web includes a controller for controlling the width of the web.

13. A web expander according to claim 8, wherein said means for expanding the width of a traveling web includes a controller for controlling the width of the web.

14. A web expander according to claim 9, wherein said means for expanding the width of a traveling web includes a controller for controlling the width of the web.

* * * * *